United States Patent [19]

Langford

[11] 4,011,694

[45] Mar. 15, 1977

[54] METHOD AND APPARATUS FOR GUYING A LOAD BEARING MEMBER

[75] Inventor: Frederic E. Langford, Redmond, Wash.

[73] Assignee: Formac International Inc., Seattle, Wash.

[22] Filed: Nov. 28, 1975

[21] Appl. No.: 635,908

[52] U.S. Cl. ..... 52/1; 52/148; 52/149; 52/152; 52/741

[51] Int. Cl.[2] ..... E04H 12/20

[58] Field of Search ..... 52/1, 146, 148, 152, 52/149, 150, 151, 741; 60/413, 476, 477; 91/390, 1; 267/74

[56] References Cited

UNITED STATES PATENTS

| | | | |
|---|---|---|---|
| 364,077 | 5/1887 | Addis | 52/152 |
| 2,128,030 | 8/1938 | Koleno | 52/148 X |
| 2,611,246 | 9/1952 | Ackerman | 60/476 X |
| 2,657,533 | 11/1953 | Schanzlin | 60/476 |
| 2,888,111 | 5/1959 | Evans | 52/148 X |
| 3,033,529 | 5/1962 | Pierrat | 52/148 X |
| 3,049,194 | 8/1962 | Brendel | 52/148 X |
| 3,156,255 | 11/1964 | Gasquet et al. | 91/1 X |
| 3,385,169 | 5/1968 | Hale et al. | 91/390 |
| 3,504,460 | 4/1970 | Solberg | 52/148 X |
| 3,736,845 | 6/1973 | Weiste et al. | 91/390 |
| 3,864,911 | 2/1975 | Gellatly | 60/476 X |

OTHER PUBLICATIONS

Spring Design and Application, Carlson, TJ 210 P7, pp. 74–76, Nov., 1961.

*Primary Examiner*—Leslie Braun
*Attorney, Agent, or Firm*—Christensen, O'Connor, Garrison & Havelka

[57] ABSTRACT

A system for guying a tower on which a force is exerted in a direction transverse to the elongate dimension thereof includes a plurality of guys interconnected between the tower and respective anchors. The guys are placed under a tension load to oppose the force exerted on the tower. An extensible device, such as a hydraulic piston and cylinder assembly, is serially interconnected with the guys at a location between the tower and the anchor. Before a force is exerted on the tower, the piston and cylinder assemblies are pre-pressurized with hydraulic fluid so as to retract the pistons and thus reduce the effective length of the guys. When the load on the guy bearing the greatest tension load reaches a predetermined value, hydraulic fluid is relieved from its associated piston and cylinder assembly, allowing the assembly to extend and increase the effective length of that guy. As this occurs, the tower will translate in the direction of the load exerted thereon, transferring a portion of the tension load that would otherwise be borne by the guy bearing the greatest load to the remaining guys. The tension load at which the piston and cylinder assembly extends is predetermined so as to prevent the tension load per unit cross sectional area of its associated guy from exceeding the ultimate strength of that guy.

20 Claims, 4 Drawing Figures

Fig. 1
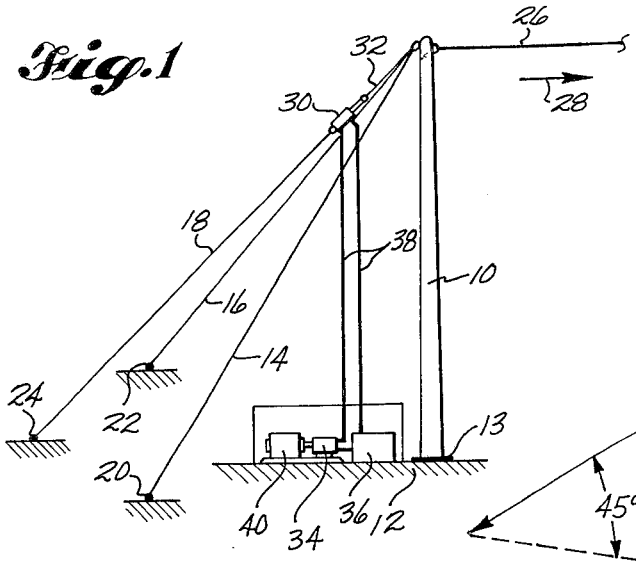
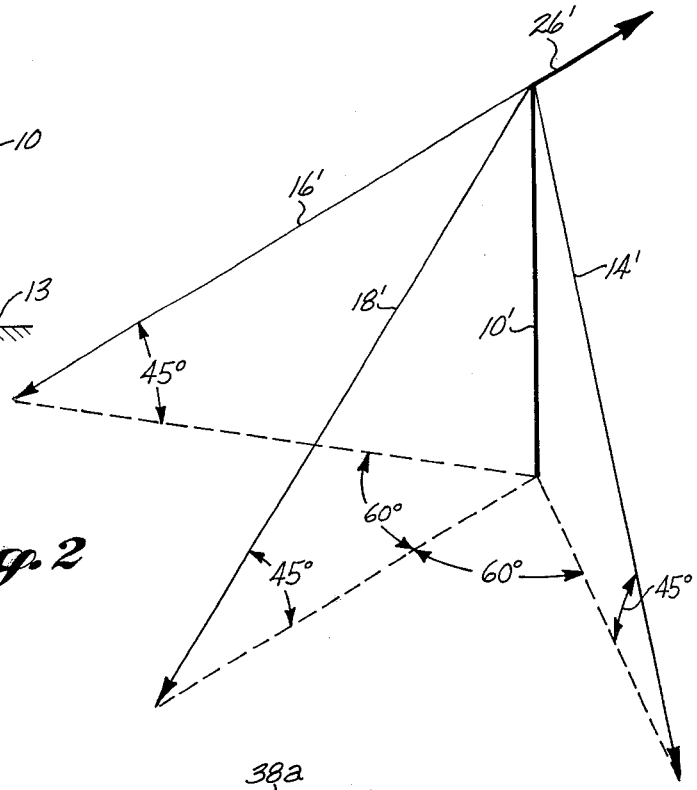
Fig. 2
Fig. 3
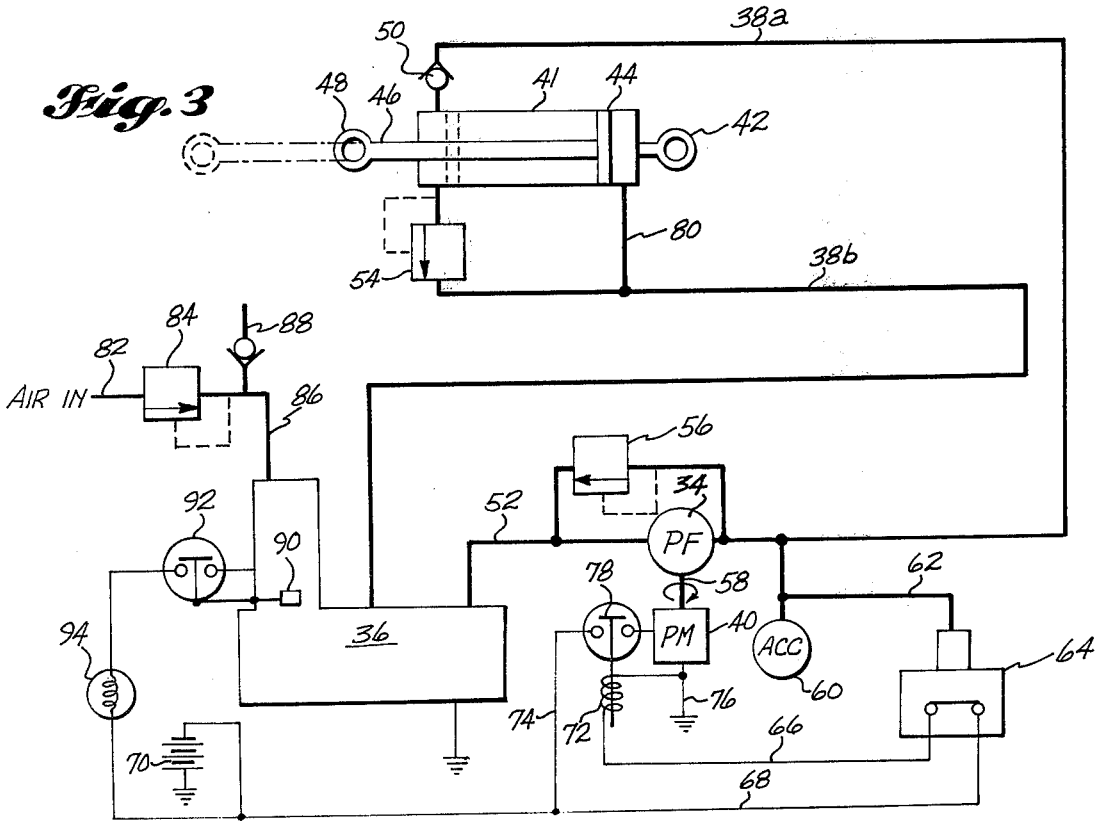

METHOD AND APPARATUS FOR GUYING A LOAD BEARING MEMBER

BACKGROUND OF THE INVENTION

The present invention relates to a method and apparatus for guying a load bearing member, and more particularly, to a method and apparatus for preventing overstressing of one or more of a plurality of guys opposing a force exerted on the load bearing member.

Towers are employed in a variety of applications in industry to support loads above the ground. Typically a force is imposed on a tower in a direction transverse to its upright dimension by a catenary cable strung between the tower and a remote location. In addition to the weight of the cable, loads are normally suspended from the catenary cable, thereby increasing the force imposed on the tower. Guys, strung between the tower and suitable anchors, are conventionally employed to counteract at least a portion of these forces imposed on the tower.

In a simple tower guying system, guys are arrayed in the plan view so that a first one of the guys extends rearwardly from the tower in a direction substantially opposite to the direction in which the force from the catenary cable is exerted on the tower. The remaining guys are deployed sidewardly from the tower and at an angle in the plan view from the first guy. In elevation view all of the guys are of the same length and are oriented at equal angles relative to direction of the forces on the tower. As an increasing force is exerted on the tower by the catenary cable, each of the guys bears a load approximately proportional to the cosine of the angle it makes in the plan view with the direction in which the force is exerted on the tower. Thus, the first guy extending rearwardly in a direction opposite to the direction of the force on the tower will carry the greatest tension load opposing the force on the tower.

As the force on the tower is increase, the tension loads in the guys will increase. Since the sidewardly extending guys bear a lesser proportion of the total opposing load, the stress in the rearwardly extending guy can reach its ultimate strength before the remaining guys, causing the rearwardly extending guy to fail and requiring the sidewardly extending guys to bear the entire tension load created by the primary load exerted on the tower. Assuming that the sidewardly extending guys are the same size as the rearwardly extending guy, this condition will overstress the sidewardly extending guys and will also cause them to fail, in turn allowing the tower to topple with potentially harmful results.

Accordingly, in a system for guying a load bearing member it is an object of the present invention to provide a method and apparatus for limiting the stress exerted on a guy opposing a variable force exerted on the load bearing member; to provide a method and apparatus for transferring a portion of the tension load otherwise being borne by the guy bearing the greatest tension load to one or more adjacent guys that normally bear a leser tension load; and to provide a method and apparatus for maintaining the tension load in the guy normally bearing the greatest tension load at a predetermined maximum value while increasing the tension load in one or more adjacent guys.

SUMMARY OF THE INVENTION

In accordance with the foregoing objects, and other objects that will become apparent to one of ordinary skill in the art after reading the following specification, the present invention provides a method for guying a load bearing member that is capable of having a variable force exerted thereon in a predetermined direction. The method includes attaching a first guy to the load bearing member and to an anchor so as to place the first guy under a predeterminable tension load when the variable force is exerted on the load bearing member and attaching at least a second guy to the load bearing member and to an anchor so as to place the second guy under a predeterminable tension load when the variable load is exerted on the load bearing member. The first and second guys are oriented relative to the direction in which the variable force is exerted on the tower so that the first guy normally bears a greater tension load then the second guy. A portion of the load being borne by the first guy is transferred to the second guy by effectively lengthening the first guy when the tension load therein reaches a predetermined value responsive to an increasing force on the load bearing member. While the first guy is effectively lengthened, the load on the first guy is maintained substantially constant at the predetermined value. The load bearing member is thereby allowed to translate in the direction of the force as that force increases, in turn increasing the load being borne by the second guy.

A preferred apparatus for carrying out the foregoing method of effectively lengthening a guy comprises a hydraulic piston and cylinder assembly having a piston rod connected to the piston. The assembly is serially interconnected with the first guy between the load bearing member and its respective anchor. The piston is reciprocable along with its associated piston rod between a retracted position and an extended position. When the assembly is in its retracted position, the effective distance between the load bearing member and the anchor is less than the effective distance when the assembly is extended. The system further includes a hydraulic fluid sump and a pump means operatively coupled to the sump and to the assembly for pumping hydraulic fluid to one side of the piston and cylinder assembly to retract the piston. A relief valve is operatively coupled between the sump and the piston and cylinder assembly to relieve hydraulic fluid from the assembly when the load on the first guy, and thus the pressure in the cylinder, reaches a predetermined value, allowing the piston to reciprocate within the assembly toward its extended position. In this manner, the effective length of the first guy is increased, allowing the load bearing member to translate in the direction of the force thereon and increase the proportion of the total tension load being borne by the second guy.

BRIEF DESCRIPTION OF THE DRAWINGS

A better understanding of the present invention can be derived by reading the ensuing specification in conjunction with the accompanying drawings wherein:

FIG. 1 is a schematic representation of a load bearing tower having a force exerted thereon in a first direction, a plurality of guys attached to the tower to oppose that force, and means for increasing the effective length of one of the guys in accordance with the present invention;

FIG. 2 is a vector diagram representative of the forces exerted on a tower and guys of the structure shown in FIG. 1;

FIG. 3 is a schematic diagram of a preferred hydraulic apparatus for effectively lengthening a guy in accordance with the present invention.

DETAILED DESCRIPTION

Figure 4:
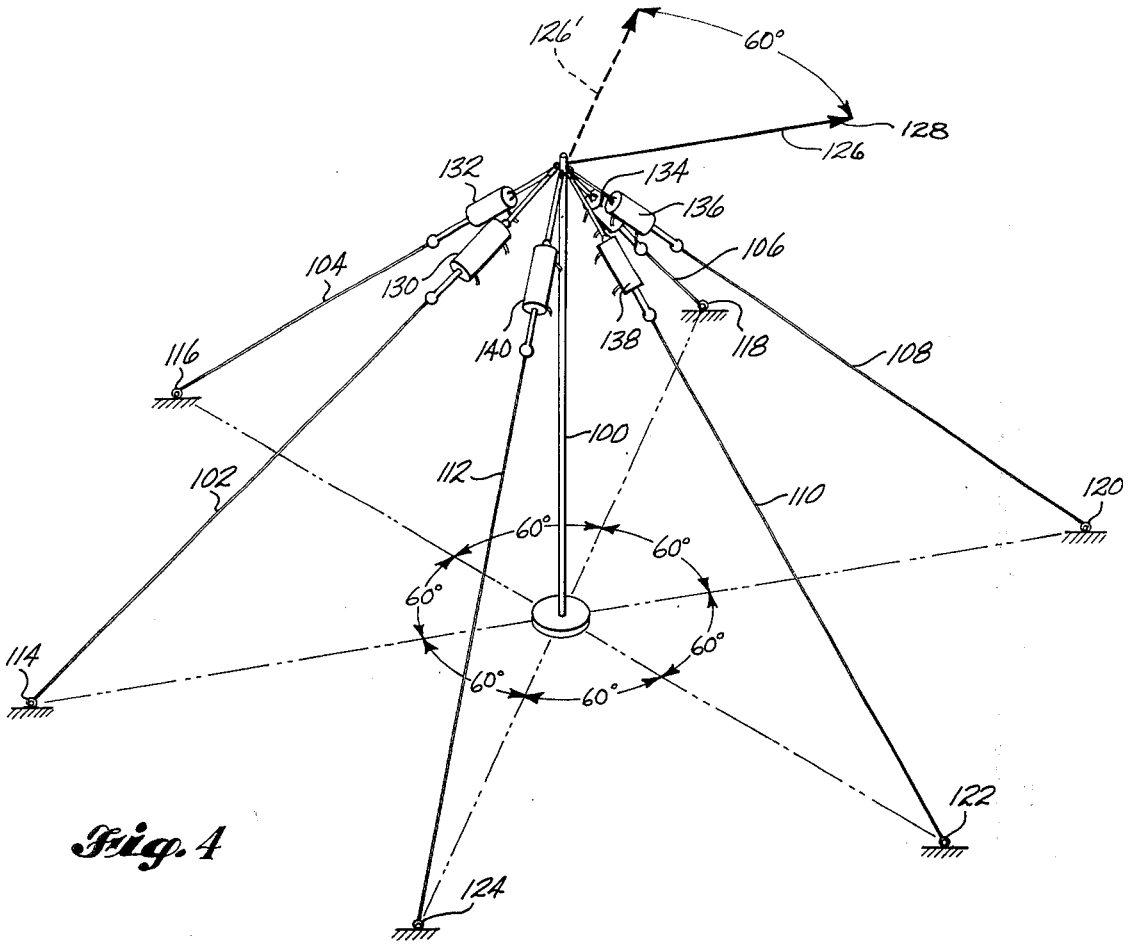
FIG. 4 is a schematic representation of a guyed tower employing the preferred hydraulic apparatus on each of several guys stabilizing a tower.

Referring to FIG. 1, a load bearing tower 10 extends upwardly from the ground 12 and has its bottom suitably attached to and supported by a platform 13 in turn secured to the ground 12. Towers of this type are normally attached to the platform by hinge-like or universal couplings so that the top of the tower can move relative to the bottom without exerting a substantial bending moment on the tower. The tower 10 is guyed by a plurality of guys 14, 16 and 18 strung between the top of the tower 10 and the ground 12. Suitable, conventional connecting devices are utilized to interconnect the top ends of the guys 14, 16 and 18 to the top of the tower 10 while suitable anchors 20, 22 and 24 are employed to secure the bottom ends of the guys 14, 16 and 18 to the ground 12. An elevated cable 26 is also attached to the top of the tower 10 by a suitable connector and extends outwardly away from the tower. When a load is applied to the elevated cable 26, a force is exerted on the tower 10 in a direction parallel to the cable, i.e., transverse to the vertical or upright dimension of the tower 10, as indicated by arrow 28. Guys 14 and 16 extend downwardly from the tower 10 to the ground 12 and sidewardly from the direction of the load applied to the elevated cable 26, while guy 18 extends downwardly from the tower to the ground and rearwardly in a direction opposite (in the plan view) to the direction of the force exerted on the tower. All three guys 14, 16 and 18 are placed under a tension load when a force is exerted on the tower via the cable 26 and tend to restrain movement of the top of the tower 10, thereby stabilizing the tower 10 relative to the ground 12. Since the guy 18 (hereafter referred to as the primary guy) is oriented at an angle relative to the direction of the force exerted on the tower that is less than the angles at which the guys 14 and 16 (hereafter the secondary guys) are oriented relative to the direction of the force, the primary guy bears the greatest tension load of the three.

Referring now to the vector diagram of FIG. 2, the force exerted on the tower by a load on the elevated cable is represented by the vector 26' oriented perpendicularly to and directed outwardly from an ordinate 10' representing the tower. The opposing tension loads placed in the guys 14, 16 and 18 are represented respectively by the vectors 14', 16' and 18' extending at angles away from the force vector 26'. For purposes of explanation, the vector 18' representing the tension load in the primary guy is oriented at an angle of 45° in the vertical plane and an angle of 0° in the horizontal plane from the direction of the force vector 26'. The vectors 14' and 16' representing the tension loads in the secondary guys are oriented at an angle of 60° in the horizontal plane and 45° in the vertical plane from the direction of the force vector 26'.

Assuming that the force represented by vector 26' equals F and that the opposing load represented by the primary opposing vector 18' equals P, it can be shown for a conventional guying system that the load represented by the secondary opposing vectors 14' and 16' is approximately P/2. The representative vector equation balancing the forces represented by the vectors 26', 14', 16' and 18' can be written as follows:

$$F = P\cos 45° + 2(P/2)\cos 45°\cos 60° \quad \text{(I)}$$

Solving this equation for P yields:

$$P = F/1.06. \quad \text{(II)}$$

Thus in a conventional guying system, it can be seen that the force exerted on the tower is 1.06 times the load in the primary guy 18. If the force exerted by the elevated cable reaches a value greater than 1.06 times the ultimate strength of the primary guy, the primary guy will fail, allowing the entire load to be transferred to the secondary guys 14 and 16. If this occurs, the ultimate strength of the secondary guys will also be exceeded (assuming they are the same size and length), causing the secondary guys to fail and allowing the tower to topple. Under conventional operating circumstances, however, it is desirable to limit the tension load in the primary guy to a predetermined safe value, for example 0.7 of the ultimate strength ($P_{uts}$) of the guy. With this limitation, the maximum force that can be exerted on the tower is determined by the relationship of Equation II. This maximum force, in terms of the ultimate strength of the guy, is then $0.742P_{uts}$.

In accordance with the present invention, the load in the primary guy can be limited to a predetermined safe value while increasing the force on the tower above that which can be achieved with a conventional guying system. This result is accomplished by maintaining the tension load in the primary guy at the predetermined safe value and transferring additional tension load to the secondary guys responsive to an increasing force on the tower. The force on the tower can be increased until the loads in the secondary guys are equalized with the predetermined safe load in the secondary guys. By so transferring a portion of the load otherwise borne by the primary guy, the force on the tower can exceed that achievable with a conventional guying system without exceeding the predetermined safe tension load in any of the guys. When the load (P) in each of the guys is equalized, a force balance equation can be written as follows:

$$F = P\cos 45° + 2P\cos 45°\cos 60°. \quad \text{(III)}$$

Solving for P yields:

$$P = F/1.41. \quad \text{(IV)}$$

Thus, when the forces on the guys are equalized in accordance with the present invention, the force on the tower can be increased by a factor of 1.41/1.06, or 1.33 without increasing the load in any of guys beyond the predetermined value. In terms of the ultimate strength of the guys, and assuming that the equalized force in each of the guys is a safe 0.7 of their ultimate strength, the maximum force that can be exerted on the tower, in terms of the ultimate strength, is $0.989\ P_{uts}$.

This result is achieved in accordance with the present invention by effectively lengthening the primary supporting guy, that is the guy normally bearing the greatest tension load such as guy 18 shown in FIG. 1, when the tension load in the primary guy reaches the predetermined safe value. As the force on the tower continues to increase, the tension load in the primary guy is maintained constant at the predetermined safe value.

As the primary guy 18 is effectively lengthened by a predetermined amount, the top of the tower 10 or other load bearing member is allowed to translate in the direction of the force being exerted thereon, i.e. in the direction shown by arrow 28 in FIG. 1. As this occurs, the secondary load supporting guys, such as guys 14 and 16 shown in FIG. 1, will oppose the increasing force exerted on the tower 10.

Referring back to FIG. 1, in accordance with one embodiment of the present invention, a hydraulic piston and cylinder assembly, generally designated 30, is serially interconnected with the primary load supporting guy 18 between the top of the tower 10 or other load bearing member and the anchor 22. Any manner of serial interconnection between the hydraulic piston and cylinder assembly 30 and the primary load supporting guy 18 is operable as long as the piston and cylinder assembly is serially connected in the load path of the primary guy between the load bearing member and the anchor. In this embodiment, the cylinder is connected to the upper end of the guy 18. A piston rod attached to the piston of the piston and cylinder assembly is attached via a short cable 32 to the top of the tower, thus placing the assembly directly in the load path of guy 18. The piston and cylinder assembly 30 is capable of reciprocation between two positions, a retracted position and an extended position. When the assembly 30 is in a retracted position, the effective length of the guy 18 between the top of the tower 10 and the anchor 22 is less than when the assembly is in its extended position or between its extended and retracted positions. It will be recognized by one of ordinary skill in the art that the travel of the piston and cylinder must be great enough to result in a adequate effective lengthening of the primary supporting guy to cause a load transference to the secondary guys. The required travel of the piston and cylinder assembly between the extended and retracted positions for a given guy system can be determined by one of ordinary skill in the art and depends upon, among other factors, the length and size (cross-sectional area) of the guys 14, 16 and 18, the angle at which the guys are oriented relative to the direction in which a force is to be applied to a load bearing member, and, of course, the material from which the guys are manufactured.

The piston and cylinder assembly 30 is coupled to a hydraulic pump 34 and a hydraulic fluid sump 36 via hydraulic lines 38. In operation, the prime mover 40 drives the hydraulic pump 34 to pump hydraulic fluid to the piston and cylinder assembly 30 to cause the piston of the assembly to retract, thus providing the guy 18 with its shortest effective length. Thereafter all of the guys 14, 16 and 18 are pretensioned in a conventional manner to stabilize the tower when the force on the tower 10 is zero or at a minimum. The fluid pressure in the hydraulic cylinder must be sufficiently high to maintain the cylinders in a retracted position under the pretensioning load.

When the force on the elevated cable 26 is increased, as by placing a load on the cable 26, the tension load in the main supporting guy 18, as well as in the secondary guys 14 and 16, is increased. When the load in the main supporting guy 18 reaches a predetermined value, the hydraulic fluid in the piston and cylinder assembly is exhausted at a constant relief pressure back to the sump 36 to allow the piston and cylinder assembly to begin to extend, increasing the effective length of the main supporting guy 18. As this occurs, the top of the tower 10 translates in the direction of arrow 28, causing the secondary supporting guys 14 and 16 to increase their proportionate share of the opposing load borne by the guys 14, 16 and 18. Since the hydraulic fluid in the piston and cylinder assembly is held at a constant pressure while it is relieved from the assembly, the load in the primary guy remains constant as long as the piston and cylinder assembly has not reached its fully extended position.

A preferred hydraulic system for operating the hydraulic piston and cylinder assembly 30 of the present invention is schematically illustrated in FIG. 3. The piston and cylinder assembly 30 comprises an enclosed cylinder 41 having a coupling ring 42 on one end thereof. A piston 44 is reciprocably mounted within the cylinder 41 and has a piston rod 46 affixed thereto, which extends axially along the cylinder 41 and through an aperture in the end wall thereof. The piston rod 46 terminates in a coupling ring 48 exterior of the cylinder 41. A hydraulic line 38a, having a check valve 50 interposed therein to allow flow only toward the cylinder, places the pressure side of the cylinder 41 (i.e., the side of the cylinder that when pressurized will cause the piston 44 to translate toward the end of cylinder 41 to which the coupling ring 42 is attached, thereby fixing the distance between the cylinder coupling ring 42 and the piston rod coupling ring 48 at a minimum) to the outlet port of the hydraulic pump 34. The inlet port of the hydraulic pump 34 is placed in fluid communication with hydraulic fluid stored in sump 36 via a hydraulic line 52. A safety pressure relief valve 56 is coupled in parallel between the inlet and outlet ports of the hydraulic fluid pump 34 to prevent damage to the pump should the pressure in line 38a exceed a safe pressure. The prime mover 40, in the preferred embodiment a direct current electric motor, is suitably coupled to drive the hydraulic pump 34 via an appropriate drive shaft 58. An accumulator 60 is also coupled to the hydraulic line 38a between the pump 34 and the hydraulic cylinder. A second hydraulic line **38*b* places the pressure side of the cylinder 41 in fluid communication with the hydraulic fluid sump 36. A second pressure relief valve, schematically illustrated as a pilot-operated pressure relief valve 54, is interposed in the hydraulic fluid line 38*b*.**

Another hydraulic line 62 is also coupled between the line **38*a* and a pressure actuated, electrical switch 64 forming part of a control and alarm system for the hydraulic circuit. The pressure switch 64 is electrically coupled via leads 66 and 68 to a source 70 of D.C. electrical energy. A relay coil 72 is connected in series with lead 66. The prime mover 40 is also coupled to the source of electrical energy 70 via leads 74 and 76. A relay contact 78, operably associated with the relay coil 72, is connected in series with the prime mover 40 and the energy source 70. In operation, the contacts of the pressure switch 64 are normally closed, resulting in energization of the relay coil 72 and closing of the normally opened relay contact 78 to energize the prime mover 40. The hydraulic pump 34 motivated by the prime mover 40 draws fluid from the hydraulic sump 36 and pumps it to the pressure side of the cylinder 41 via hydraulic line 18*a*. As the hydraulic fluid fills the pressure side of the cylinder, the piston 44 is translated to its retracted position. When the pressure in the pressure side of the cylinder 41 reaches a predetermined value, that pressure is transmitted via hydraulic line 38*a* and hydraulic line 62 to the pressure switch 64.**

When the pressure switch 64 senses the predetermined pressure, the contacts thereof open, de-energizing the relay coil 72 and allowing its associated relay contact 78 to move to its normally open position. As this occurs, the power circuit to the prime mover 40 is opened, de-energizing the prime mover to stop the hydraulic pump 34. In this manner, the hydraulic piston and cylinder assembly 30 is retracted and prepressurized, causing the primary supporting guy 18 to assume its shortest effective length.

When a tension load is exerted on primary supporting guy 18, the pressure of the hydraulic fluid in the pressure side of the cylinder 41 will reflect a proportional pressure value. The relief valve 54 is preset to relieve the hydraulic fluid in the cylinder at a predetermined pressure corresponding to the maximum desirable load in the primary guy. When the load in the guy reaches the maximum desirable value, hydraulic fluid is exhausted from the cylinder through the relief value and is returned via line **38*b* to the sump 36. As this occurs, the piston begins to translate from its retracted position toward its extended position, shown in ghost outline in FIG. 3, resulting in an increase in the distance between the cylinder coupling ring 42 and the piston rod coupling ring 48. In this manner, the effective length of the guy 18 is increased, resulting in a load transference to the secondary supporting guys as explained above. The piston will continue to translate and effectively lengthen the primary guy until the force exerted on the tower is balanced by the predetermined load on the primary guy and the increased loads on the secondary guys. When the load in the primary supporting guy 18 is decreased, a corresponding pressure decrease will occur on the pressure side of the cylinder 41. When the fluid pressure in the pressure side of the cylinder drops below the value preset in the pressure switch 64, the contacts of the pressure switch will close to re-energize the prime mover 40, to in turn pump hydraulic fluid to the pressure side of the cylinder 41 and translate the piston 44 back to its retracted position. As the piston is retracted, the effective length of the primary guy 18** is decreased, causing the top of the tower to return to its original, stabilized position wherein all the guys are only under the original pretensioning load.

In the preferred hydraulic system an additional hydraulic line 80 is coupled between the low pressure side of the cylinder 41 and the hydraulic line **38*b*. The primary purpose of this connection is to supply hydraulic fluid to the low pressure side of the cylinder as the piston extends and to exhaust hydraulic fluid from the low pressure side when the piston is retracted. Because the piston and cylinder assembly is elevated some distance above the ground in the preferred embodiment, the static head of the hydraulic fluid on the low pressure side of the cylinder is greater than atmospheric pressure. To compensate for this pressure differential, pressurized air or other compressible gas is supplied from a suitable source 82 to an air pressure regulating valve 84 coupled by a pneumatic line 86 to the sump 36. The entire hydraulic system is thus pre-pressurized to a desired value, for example 50 psi, sufficient to overcome the pressure differential between the static head and atmospheric pressure. A safety relief valve 88 is placed in fluid communication with the pneumatic line 86** to relieve excessive air pressure in the sump when necessary and to bleed the air pressure from the hydraulic system as desired.

Since the piston and cylinder assembly holds a lesser volume of oil when it is in its retracted position than when it is in its extended position because of the volume occupied by the piston rod, a unique system can be employed to provide a visual indication as to when the hydraulic piston and cylinder assembly 30 is in its extended position. This displacement differential will cause a proportional variation in the level of hydraulic fluid in the sump 36 as the piston rod reciprocates within the cylinder. By appropriately positioning a suitable float 90 in the sump that cooperates with a float switch 92, this level variation can be employed to provide an indication of the position of the piston 44 within the cylinder 41. The float switch 92 and float 90 are constructed so that when the sump volume is at its highest level, i.e. when the piston and cylinder assembly is in its retracted position, the contacts of the float switch 92 are open. The float switch is connected in series with an indicator bulb 94 and the electrical energy source 70. When the piston and cylinder assembly extends, the level of hydraulic fluid in the sump 36 drops, moving the float 90 downwardly and causing the float switch contact 92 to close and energize the bulb 94. Other indicators and alarms can be employed in this circuit as desired. Moreover, the indicating bulb 94 can be positioned at the location of an operator responsible for controlling the force applied to the tower 10 or other load bearing member.

In most practical applications in which the present invention can be employed, the force exerted on the tower or other load bearing member may not always be applied in the same direction. Referring to FIG. 4, a schematic depiction of a typical guy deployment for a spar pole 100 used in a system for yarding logs is shown. In this embodiment of the invention, six guys 102, 104, 106, 108, 110 and 112 are strung from the top of the pole to respective ground anchors 114, 116, 118, 120, 122 and 124 to stabilize the pole. A fixed or running skyline 126 is attached to the top of the pole in a conventional manner. When the skyline is loaded, a force is applied in a direction transverse to the pole 100 as indicated by the arrow 128. Hydraulic piston and cylinder assemblies 130, 132, 134, 136 138 and 140 are serially interconnected respectively with guys 102, 104, 106 108, 110 and 112 and are coupled to suitable hydraulic circuits in a manner similar to the simplified system described above in conjunction with FIG. 1.

In this embodiment, the guys are deployed from the top of tower downwardly toward the ground at an angle of 45° with the pole and are equally spaced around the pole so that each guy is separated from the other in a plane perpendicular to the pole by an angle of 60°. When a force is exerted on the skyline 126 in the direction indicated by arrow 128, i.e., perpendicularly to the pole and opposite to guy 102, guy 102 will act as the primary guy bearing the greatest tension load opposing the force in the skyline, while the guys 104 and 112 will act as secondary guys. When each of the relief valves coupled to each of the respective cylinders serially connected with the guys is set to relieve the fluid pressure in the cylinders when the load in each of the guys exceeds a predetermined safe value, for example 0.7 of the ultimate strength of the guys, this system will function identically to the simple system previously described until the load in the secondary guys reaches the predetermined safe value. When the load in the secondary guys reaches the predetermined safe value, the relief valves coupled to the cylinders 132 and 134 serially connected with the secondary guys 104 and 112 will begin relieving fluid from those cylinders, preventing the load in the secondary guys from exceeding the predetermined safe value.

At this juncture, it must be noted that the piston and cylinder assemblies do have limited reciprocation travel. The piston and cylinder assemblies can be designed so that the cylinder 130 serially connected with the primary guy 102 will reach the limit of its extension after the cylinders on the secondary guys have only partially extended. At that point the primary guy would continue to bear a load greater than the predetermined safe value responsive to an increasing force on the skyline 126, while the load in the secondary guys would remain constant as their respective piston and cylinder assemblies continued to extend. Before this would occur, however, the visual indicators or other alarms that warn of the extended condition of each of the cylinders would signal the operator responsible for applying the force to the skyline 126 that a force greater than the maximum desirable force is being applied to the tower. When this condition becomes apparent to the operator, prudent action dictates a reduction in the force applied to the tower, thus allowing one or more of the cylinders to return to its retracted position under urging from the hydraulic fluid supplied by the hydraulic fluid system.

If a force is applied to the pole in a direction other that that described above, for example in the direction of dotted arrow 126' offset 60° from arrow 128 in a plane perpendicular to the spar pole 100, guy 112 will function as the primary load bearing guy while adjacent guys 102 and 110 will function as the secondary guys. The system operation is identical to that described immediately above, with the exception that the piston and cylinder assembly 140 would be the first to extend. In the same manner, a force can be applied to the tower in any direction with the system for effectively lengthening the primary load supporting guy functioning in substantially the same manner.

One of ordinary skill in the art will understand that the method and apparatus for preventing overstressing of a guy disclosed in the foregoing specification will be operable in a variety of environments. Normally, three or more guys will be employed to oppose a force applied to a given load bearing member and to stabilize or restrain the load bearing member from moving in directions both transverse and parallel to the direction in which the force is applied. The present invention is also operable when only two guys are employed at appropriate angles relative to the force direction as long as the load bearing member is otherwise restrained from substantial movement in a direction transverse to the direction of the applied force.

The present invention has been broadly described and a preferred mode of carrying out that invention has been disclosed. After reading the foregoing specification, one of ordinary skill in the art will be able to effect various changes, substitutions of equivalents and other alterations without departing from the broad concept as disclosed. For example, a preloaded tension spring with a uniform spring fuse can be substituted for the hydraulic piston and cylinder assembly. The spring could be manufactured so that it will not extend until a predetermined load has been placed upon it, after which it will extend without varying the load required to extend it. Moreover, the guys can be deployed at any of a variety of angles relative to the tower depending upon the particular environment in which a given load bearing member is being used. It is therefore intended that the grant of Letters Patent hereon be limited only by the definition continued in the appended claims.

What is claimed is:

1. In an apparatus for guying a load bearing member capable of having a variable force exerted thereon in a predetermined direction including a first guy and means for attaching said first guy to said load bearing member and to an anchor so as to place said first guy under a predeterminable tension load when said variable force is exerted on said member, a second guy and means for attaching said second guy to said member and to a second anchor so as to place said second guy under a predeterminable tension load when said variable force is exerted on said member, said second guy being oriented relative to said predetermined direction so that the predeterminable tension load in said first guy is greater than the predeterminable tension load in said second guy, an improvement for transferring a portion of the load being borne by said first guy to said second guy when said variable force is exerted on said member, comprising:

extensible means serially interconnected with said first guy between said member and said anchor so that the tension load placed on said first guy is transferred along a load path from said load bearing member through said guy and said extensible means to said anchor, said extensible means for effectively lengthening said first guy when the tension load therein reaches a predetermined value in response to an increase in said variable force exerted on said member and for maintaining the tension load on said first guy substantially equal to said predetermined value as said first guy is effectively lengthened, thereby allowing said load bearing member to translate in said predetermined direction to increase the load being borne by said second guy as said load bearing member translates.

2. The apparatus of claim 1 wherein said predetermined value of said tension load per unit cross-sectional area of said first guy is less than the ultimate strength of said first guy.

3. The apparatus of claim 2 wherein said extensible means effectively lengthens said first guy responsive to an increase in said variable force by an amount sufficient to allow said second guy to bear a load substantially equal to said predetermined value.

4. The apparatus of claim 1 further comprising:

means operably associated with said extensible means for allowing said extensible means to gradually lengthen said first guy to prevent an abrupt load transference to said second guy.

5. The apparatus of claim 1 further comprising means operably associated with said extensible means for limiting the extension thereof to a predetermined amount.

6. The apparatus of claim 1 further including a third guy and means for attaching said third guy to said member and to a third anchor so as to place said third guy under a predeterminable tension load when said variable force is exerted on said member, said third guy being oriented relative to said predetermined direction so that the predeterminable tension load in said third guy is les than the predeterminable tension load in said first guy, said second guy being located on one side of said first guy and said third guy being located on the other side of said first guy, said improvement further comprising:

second extensible means serially interconnected with said second guy between said member and said anchor so that the tension load placed on said second guy is transferred along a load path from said load bearing member through said second guy and said second extensible means to said second anchor, said second extensible means for effectively lengthening said second guy when the tension load therein reaches a predetermined value in response to an increase in said variable force exerted on said tower, and third extensible means serially interconnected with said third guy between said member and said anchor so that the tension load placed on said third guy is transferred along a load path from said load bearing member through said third guy and said third extensible means to said third anchor, said third extensible means for effectively lengthening said third guy when the tension load therein reaches a predetermined value in response to an increase in said variable force exerted on said tower.

7. The apparatus of claim 1 wherein said extensible means comprises:

an assembly including a hydraulic piston, a cylinder and a rod connected to said piston and means associated with said rod and said cylinder for serially interconnecting said assembly with said first guy between said load bearing member and said anchor associated with said first guy, said piston and rod being reciprocable between a retracted position wherein the effective distance between said anchor and said load bearing member associated with said first guy is a first predetermined distance and an extended position wherein the effective distance between said anchor and said load bearing member associated with said first guy is a second predetermined distance greater than said first predetermined distance, a hydraulic fluid sump, pump means operatively coupled to said sump and to said cylinder for pumping hydraulic fluid to said cylinder on one side of said piston to translate said piston to said retracted position, and relief valve means operatively coupled between said sump and said cylinder on the one side of said piston for relieving hydraulic fluid from said cylinder when the fluid pressure therein reaches a first pressure value corresponding to said predetermined value of the tension load in said first guy to allow said piston to translate toward said extended position while maintaining the fluid pressure in said cylinder substantially at said first pressure value.

8. The system of claim 7 wherein said pump means is operable to raise the hydraulic fluid pressure in said cylinder on said one side of said piston to a second predetermined pressure value less than said first predetermined pressure value.

9. The system of claim 8 wherein said pump means includes a prime mover, said system further comprising:

pressure switch means operatively associated with said cylinder for detecting the pressure in said cylinder on the one side of said piston and operatively associated with said prime mover for de-energizing said prime mover when said pressure reaches said second predetermined pressure value and for energizing said prime mover when said pressure falls below said second predetermined pressure value.

10. The system of claim 9 further comprising:

means for pre-pressurizing the fluid in said sump to a third predetermined pressure value lower than said second predetermined pressure value.

11. The system of claim 9 wherein said piston and cylinder assembly is so constructed and arranged as to hold a greater volume of hydraulic fluid when extended than when retracted, thereby causing a variation in the level of hydraulic fluid in said sump as said piston reciprocates in said cylinder, said system further comprising:

means for detecting the variation in the level of hydraulic fluid in said sump, and means responsive to said means for detecting for providing an indication that said piston and cylinder assembly is extended.

12. The system of claim 7 further comprising:

a first fluid conduit means operatively coupled between said sump and said cylinder on the other side of said piston for supplying hydraulic fluid to said cylinder when said piston reciprocates from said retracted position to said extended position.

13. In a method for guying a load bearing member wherein a variable force is exerted on said member in a predetermined direction including the steps of:

a. attaching a first guy to said member and to an anchor so as to place said first guy under a predeterminable tension load when said variable force is exerted on said member, b. attaching at least a second guy to said member and to an anchor so as to place said second guy under a predeterminable tension load when said variable force is exerted on said member, said first and second guys being oriented relative to said predetermined direction so that the predeterminable tension load on said first guy is greater than the predeterminable tension load on said second guy, an improvement for transferring a portion of the tension load being borne by said first guy to said second guy upon increasing said variable force comprising the steps of:

c. effectively lengthening said first guy when the tension load therein reaches a predetermined value as said variable force is increased, thereby allowing said load bearing member to translate in the direction of said variable force, and d. maintaining the tension load on said first guy substantially equal to said predetermined value as said first guy is effectively lengthened responsive to an increasing variable force, and thereby increasing the tension load being borne by said second guy as said load bearing member translates.

14. The method of claim 13 wherein said predetermined value of said tension load per unit cross-sectional area of said first guy is less than the ultimate strength of said first guy.

15. The method of claim 14 wherein said first guy is effectively lengthened as said variable force is increased by an amount sufficient to allow said second guy to bear a load substantially equal to the load being borne by said first guy.

16. The method of claim 13 wherein said first guy is gradually effectively lengthened as said variable force is increased to prevent an abrupt load transference to said second guy.

17. The method of claim 13 wherein said first guy is effectively lengthened when the load therein reaches a predetermined value by:

serially interconnecting an extensible member with said first guy between said load bearing member and said anchor and allowing said extensible member to bear the same tension load as said guy, retracting said extensible member and preventing said extensible member from from extending to effectively lengthen said guy until the load on said extensible member reaches a predetermined value, and extending said extensible member when the tension load on said first guy reaches said predetermined value to effectively lengthen said first guy and effect a load transference to said second guy.

18. The method of claim 17 wherein said extensible member continues to extend responsive to an increase in said variable force above a value exceeding said predetermined value on said first guy while maintaining the tension in said first guy at said predetermined value.

19. In the method of claim 17 the improvement further comprising the step of:

retracting said extensible member after it has extended when the tension load in said first guy drops below said predetermined value responsive to a decreasing variable force.

20. The method of claim 13 wherein the method for guying a load bearing member further includes the step of attaching a third guy to said member and to an anchor so as to place said third guy under a predeterminable tension load when said variable force is exerted on said member, the predeterminable tension load on said third guy being less than the predeterminable tension load on said first guy, said improvement further comprising the step of:

effectively lengthening said second and third guys when the tension load therein reaches a predetermined value as said variable load is increased.

* * * * *